US010820078B2

(12) United States Patent
Niu et al.

(10) Patent No.: US 10,820,078 B2
(45) Date of Patent: Oct. 27, 2020

(54) SPEAKER BOX

(71) Applicant: AAC Technologies Pte. Ltd., Singapore (SG)

(72) Inventors: Peng Niu, Shenzhen (CN); Guoxiu Feng, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/438,388

(22) Filed: Jun. 11, 2019

(65) Prior Publication Data

US 2019/0379958 A1 Dec. 12, 2019

(30) Foreign Application Priority Data

Jun. 12, 2018 (CN) ..... 2018 2 0908743 U

(51) Int. Cl.
*H04R 1/02* (2006.01)
*H04R 1/28* (2006.01)

(52) U.S. Cl.
CPC ..... *H04R 1/025* (2013.01); *H04R 1/026* (2013.01); *H04R 1/2807* (2013.01); *H04R 1/2811* (2013.01); *H04R 1/2888* (2013.01); *H04R 2201/02* (2013.01); *H04R 2201/029* (2013.01); *H04R 2400/11* (2013.01); *H04R 2499/11* (2013.01)

(58) Field of Classification Search
CPC ..... H04R 1/025; H04R 1/026; H04R 1/2807; H04R 9/06; H04R 2201/02; H04R 2400/11; H04R 2499/11; H04R 1/2888; H04R 2201/029
USPC ..... 381/386, 395, 396, 431, 433, 345, 349, 381/350
See application file for complete search history.

(56) References Cited

U.S. PATENT DOCUMENTS 7,200,241 B2 * 4/2007 Fukuyama ..... H04R 1/06 381/407
7,953,461 B2 * 5/2011 Fukazawa ..... H04M 1/03 455/569.1
2017/0289658 A1 * 10/2017 Mu ..... H04R 1/02

* cited by examiner

*Primary Examiner* — Huyen D Le
(74) *Attorney, Agent, or Firm* — W&G Law Group LLP

(57) ABSTRACT

The speaker box provided by the present disclosure includes a housing with an accommodation space and a speaker in the accommodation space. The speaker includes a diaphragm for radiating sound. The housing includes a ring-shaped step for fixing the speaker. The step further forms a fastening slot for fixing the speaker. The stop further includes a number of recesses extending from a surface toward the fastening slot along a direction away from the fastening slot. BY virtue of the recesses, without changing the vibration space, the acoustic capacitor of the front cavity is increased, and the harmonic peak is lowered. Acoustic performance is accordingly improved.

7 Claims, 3 Drawing Sheets

SPEAKER BOX

FIELD OF THE PRESENT DISCLOSURE

The present disclosure relates to the field of electromagnetic transducers, more particularly to a speaker box used in a portable electronic device.

DESCRIPTION OF RELATED ART

A speaker is a very important component equipped in a mobile phone for producing audible sounds. A speaker generally uses a diaphragm to produce vibration and further to generate sounds.

A speaker box is a component containing a speaker and a housing receiving the speaker. Compared to a speaker, a speaker box has a relatively larger back volume and better low frequency acoustic performance. The speaker box has a sound aperture for radiating sound. The speaker assembly is generally a long-and-narrow configuration and placed deviating from a center of the housing for balancing the acoustic performance and the occupation.

For improving the flexibility of mounting the speaker box into a device, the speaker box is generally configured to be a side-sounding structure. The side-sounding structure means the speaker box is provided with a sound aperture via which the sound is transmitted outside along a direction perpendicularly to the direction along which the diaphragm vibrates.

Such a configuration will cause frequency-resonance peak (harmonic peak), which will badly affect the acoustic performance of the speaker box.

Therefore, an improved speaker box is desired.

SUMMARY OF THE PRESENT DISCLOSURE

One of the primary objects of the present disclosure is to provide a speaker box capable of reducing distortion and improving acoustic performance.

Therefore, the present disclosure provides a speaker box, including a housing with an accommodation space and a speaker in the accommodation space. The speaker includes a diaphragm for radiating sound. The housing includes a ring-shaped step for fixing the speaker. The step further forms a fastening slot for fixing the speaker. The stop further includes a number of recesses extending from a surface toward the fastening slot along a direction away from the fastening slot. BY virtue of the recesses, without changing the vibration space, the acoustic capacitor of the front cavity is increased, and the harmonic peak is lowered. Acoustic performance is accordingly improved.

Further, the plurality of recesses are arranged in a matrix.

Further, the housing includes a top case and a lower case engaging with the top case for forming the accommodation space; and the step is disposed on the top case.

Further, the top case includes a bottom wall, the step includes a top surface opposite to the bottom wall and a side surface facing the fastening slot for connecting the top surface to the bottom wall; and the recesses are formed by recessing from the side surface away from the fastening slot.

Further, the recesses extend from the bottom wall toward the top surface and penetrate the top surface.

Further, a cross-section of the recess along a direction parallel to the diaphragm is rectangle, triangle, or semicircle.

Further, the top case further includes a sidewall extending from the bottom wall, and the step is formed on the sidewall; the sidewall further includes a sound aperture communicating with the front cavity.

Further, the sidewall further includes a sounding portion protruding away from the accommodation space, and the sound aperture is formed in the sounding portion.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
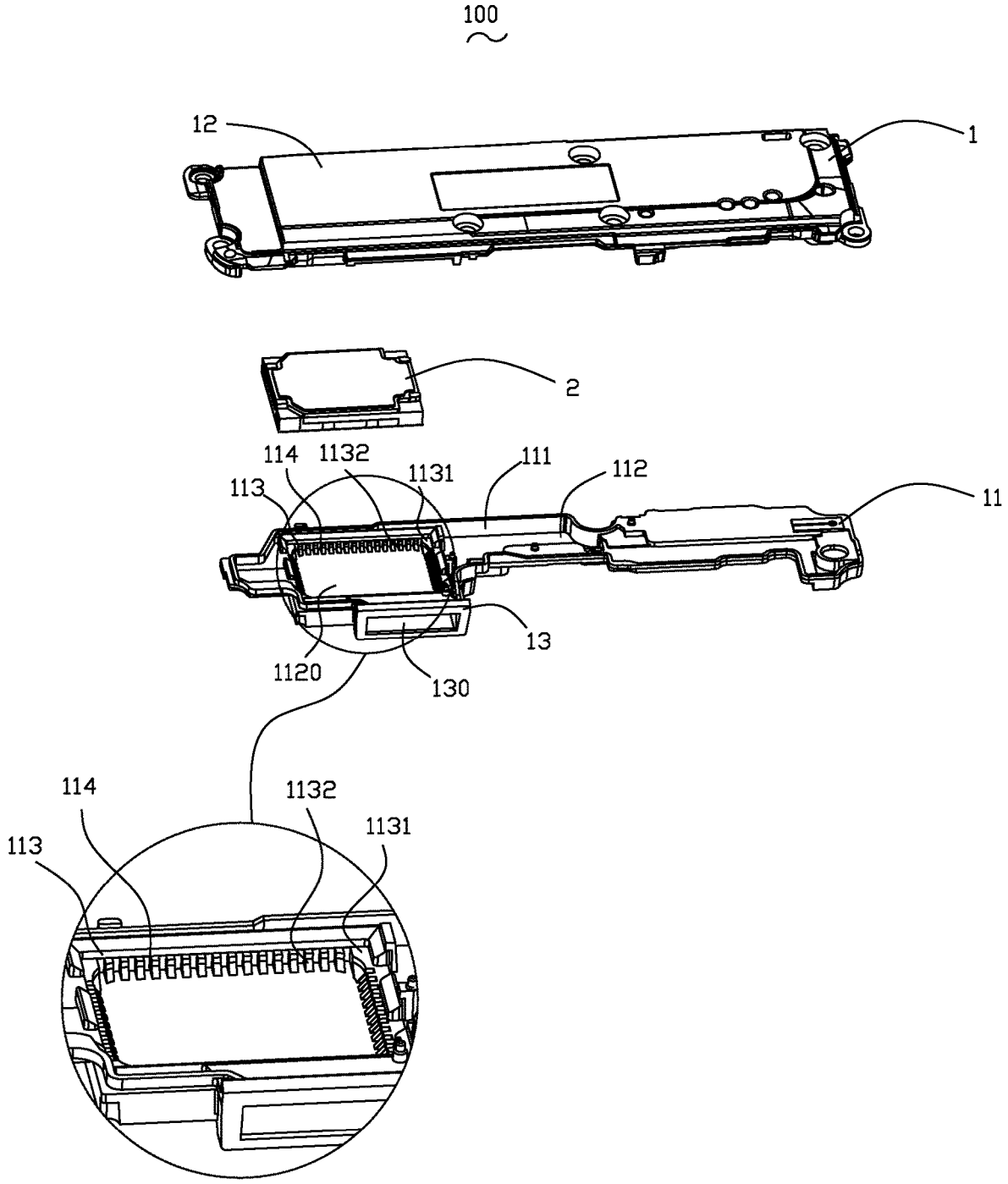
FIG. 1 is an isometric and exploded view of a speaker box in accordance with a first embodiment of the present disclosure.

Referring to FIG. 1, a speaker box 100 in accordance with a first embodiment of the present disclosure includes a housing with an accommodation space and a speaker 2 received in the accommodation space.

The housing 1 includes a lower case 12, a top case 11 engaging with the lower case 12 for forming the accommodation space. The top case 11 includes a sidewall 111 and a bottom wall 112. The sidewall 111 extends perpendicularly from the bottom wall 112.

The top case 11 includes a ring-shaped step 113 for fixing the speaker 2. In this embodiment, the step 113 is formed by recessing from a surface o he sidewall 111 away from the bottom wall 112 along a direction toward the bottom wall 112. The step 113 and the bottom wall 112 cooperatively form a fastening slot 1120. The fastening slot 1120 is disposed at a central portion of the bottom wall 112, by which the speaker 2 keeps a distance from the sidewall 111.

The step 113 includes a top surface 1131 opposite to the bottom wall 112, and a side surface 1132 connecting the top surface 1131 to the bottom wall 112. In the embodiment, the top surface 1131 extends from the sidewall 111, and the side surface 1132 is parallel to the sidewall 111. The step 113 is a part of the sidewall 111. Another word, the step 113 is integral with the sidewall 111.

The speaker 2 is an electro-magnetic speaker including a diaphragm and a coil for driving the diaphragm. The speaker 2 is such configured that a side of the speaker adjacent to the diaphragm is mounted with the fastening slot 1120. The speaker 2 forms a front cavity cooperatively with the top case 11. Specifically, the diaphragm, the step 113 and the bottom wall 112 form cooperatively the front cavity. A back cavity is formed by the diaphragm and the lower case 12. The back cavity communicates with a back sound cavity of the speaker 2 for enlarging the back volume of the speaker, which improves the low frequency response and obviously lowers the resonance frequency ($F_0$). Alternatively, the speaker 2 could be other transducer, other than electro-magnetic speaker.

The step 113 is provided with a plurality of recesses 114 for enlarging the acoustic capacitor C of the front cavity. The recesses are formed by recessing from a surface of the step 113 facing the fastening slot 1120 along a direction away from the fastening slot 1120, by which the acoustic capacitor of the front cavity is improved with the height along the vibration direction not changed. In the embodiment, the recesses 114 recess from the side surface 1132 along a direction away from the fastening slot 1120. Along the vibration direction, the recesses 114 extend from the bottom wall toward the top surface 1131 and penetrates the top surface 1131. The recesses 114 are arranged in an array evenly disposed around the step 113.

Figure 2:
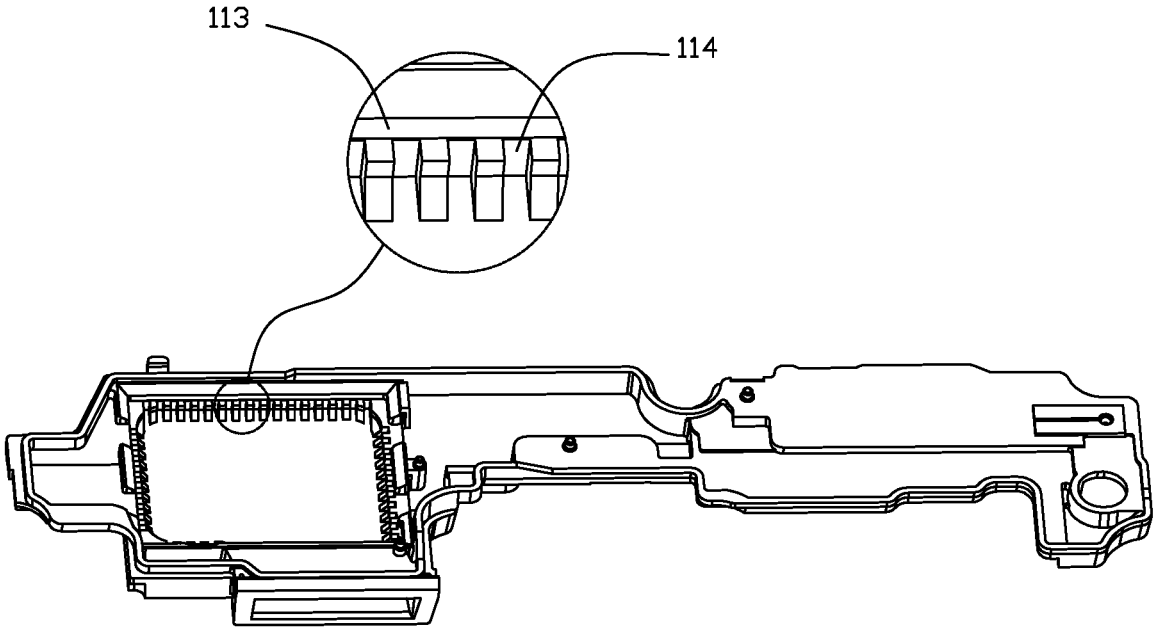
FIG. 2 is an isometric view of a top case of the speaker box in FIG. 1.
Figure 3:
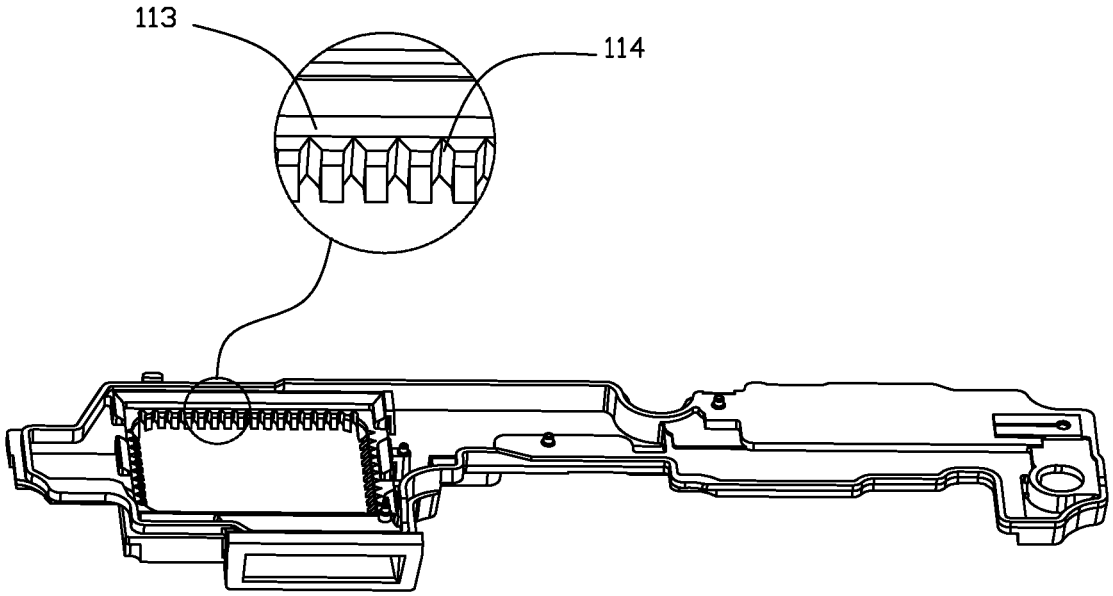
FIG. 3 is an isometric view of a top case of a speaker box in accordance with a second exemplary embodiment of the present disclosure.
Figure 4:
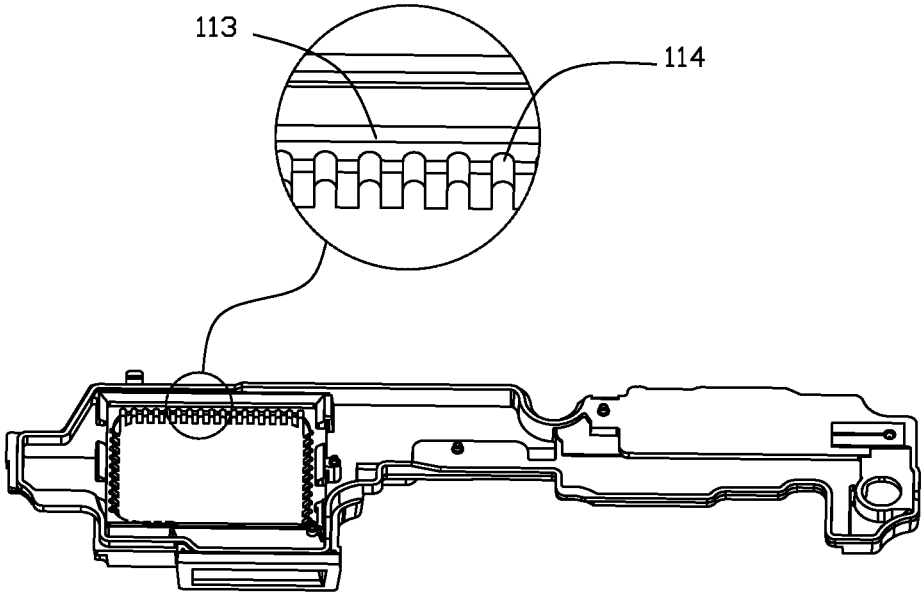
FIG. 4 is an isometric view of a top case of a speaker box in accordance with a third embodiment of the present disclosure.

Referring to FIGS. 2-4, three exemplary embodiments of the top case are illustrated. A cross-section of the recess 114 along a direction parallel to the diaphragm is rectangle, triangle, or semi-circle. The sizes of the recess 114, including dimension and depth, can be adjusted according to actual requirements.

Further, the sidewall 111 includes a sounding portion 13 protruding away from the accommodation space. A sound aperture 130 is formed in the sounding portion 13 for transmitting the sound produced by the speaker.

The speaker box provided by the present disclosure includes a housing with an accommodation space and a speaker in the accommodation space. The speaker includes a diaphragm for radiating sound. The housing includes a ring-shaped step for fixing the speaker. The step further forms a fastening slot for fixing the speaker. The stop further includes a number of recesses extending from a surface toward the fastening slot along a direction away from the fastening slot. BY virtue of the recesses, without changing the vibration space, the acoustic capacitor of the front cavity is increased, and the harmonic peak is lowered. Acoustic performance is accordingly improved.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, including:

a housing with an accommodation space; the housing includes a top case and a lower case engaging with the top case for forming the accommodation space; the top case includes a bottom wall and a sidewall extending from the bottom wall;

a speaker received in the accommodation space, including a diaphragm for radiating sound;

the speaker forms a front cavity cooperatively with the top case, the sidewall further includes a sound aperture communicating with the front cavity;

wherein the housing includes a ring-shaped step for forming a fastening slot by which the speaker is fastened, the step further includes a plurality of recesses recessing from a surface facing the fastening slot along a direction away from the fastening slot.

2. The speaker box as described in claim 1, wherein the plurality of recesses are arranged in a matrix.

3. The speaker box as described in claim 1, wherein the step is disposed on the top case.

4. The speaker box as described in claim 3, wherein the step includes a top surface opposite to the bottom wall and a side surface facing the fastening slot for connecting the top surface to the bottom wall; and the recesses are formed by recessing from the side surface away from the fastening slot.

5. The speaker box as described in claim 4, wherein the recesses extend from the bottom wall toward the top surface and penetrate the top surface.

6. The speaker box as described in claim 1, wherein a cross-section of the recess along a direction parallel to the diaphragm is rectangle, triangle, or semi-circle.

7. The speaker box as described in claim 1, wherein the sidewall further includes a sounding portion protruding away from the accommodation space, and the sound aperture is formed in the sounding portion.

* * * * *